US007874022B2

(12) United States Patent
McQueer

(10) Patent No.: US 7,874,022 B2
(45) Date of Patent: Jan. 25, 2011

(54) PROTECTIVE ATHLETIC GARMENT

(76) Inventor: Pamela S. McQueer, 340 Washington St., Otsego, MI (US) 49078

( * ) Notice: Subject to any disclaimer, the term of this patent is extended or adjusted under 35 U.S.C. 154(b) by 1367 days.

(21) Appl. No.: 10/987,889

(22) Filed: Nov. 12, 2004

(65) Prior Publication Data

US 2005/0102741 A1 May 19, 2005

Related U.S. Application Data

(60) Provisional application No. 60/519,446, filed on Nov. 12, 2003.

(51) Int. Cl.
*A41D 27/26* (2006.01)

(52) U.S. Cl. ..... 2/461; 2/463

(58) Field of Classification Search ..... 2/459–463, 2/467, 2.5

See application file for complete search history.

(56) References Cited

U.S. PATENT DOCUMENTS

| | | | | | |
|---|---|---|---|---|---|
| 181,261 | A | * | 8/1876 | Hayward | 2/92 |
| 1,721,739 | A | * | 7/1929 | Kennedy | 2/463 |
| 2,071,827 | A | * | 2/1937 | Glahe | 2/462 |
| 2,163,463 | A | * | 6/1939 | Kennedy | 2/462 |
| 2,402,292 | A | * | 6/1946 | Nichols | 450/86 |
| 2,468,841 | A | * | 5/1949 | Siegel | 2/463 |
| 3,528,106 | A | * | 9/1970 | Austin | 2/462 |
| 3,532,096 | A | * | 10/1970 | Seidl | 450/39 |
| 4,183,097 | A | * | 1/1980 | Mellian | 2/2.5 |
| 4,322,858 | A | * | 4/1982 | Douglas | 2/463 |
| 4,467,475 | A | * | 8/1984 | Gregory et al. | 2/462 |
| 4,516,273 | A | * | 5/1985 | Gregory et al. | 2/462 |
| 4,554,681 | A | * | 11/1985 | Kirkland | 2/462 |
| 4,578,821 | A | * | 4/1986 | Zufle | 2/2.5 |
| 4,590,622 | A | * | 5/1986 | Wolfe et al. | 2/462 |
| 4,679,253 | A | * | 7/1987 | Mitchell et al. | 2/462 |
| 4,698,845 | A | * | 10/1987 | Cosby | 2/462 |
| 4,715,066 | A | * | 12/1987 | Mitchell et al. | 2/462 |
| 4,868,925 | A | * | 9/1989 | Mitchell | 2/462 |
| 4,926,503 | A | * | 5/1990 | Wingo, Jr. | 2/461 |
| 4,989,265 | A | * | 2/1991 | Nipper et al. | 2/462 |
| 5,020,157 | A | * | 6/1991 | Dyer | 2/2.5 |
| 5,022,887 | A | * | 6/1991 | Lawson | 450/54 |
| 5,029,341 | A | * | 7/1991 | Wingo, Jr. | 2/462 |
| 5,129,101 | A | * | 7/1992 | Douglas | 2/462 |
| 5,173,964 | A | * | 12/1992 | Ball et al. | 2/461 |
| 5,226,192 | A | * | 7/1993 | Jones et al. | 2/461 |
| 5,353,437 | A | * | 10/1994 | Field et al. | 2/462 |
| 5,390,368 | A | * | 2/1995 | Chang | 2/462 |
| 5,596,768 | A | * | 1/1997 | Wang | 2/462 |

(Continued)

*Primary Examiner*—Alissa L Hoey
(74) *Attorney, Agent, or Firm*—Nash & Titus, LLC; Caroline Nash

(57) ABSTRACT

A protective athletic garment includes a pair of shoulder protection plates, a pair of epaulets coupled to the shoulder protection plate, and at least one rear arch plate adapted to cover an upper lumbar region of a back of a user and wrap about each side of a user and at least one front arch plate adapted to cover at least a portion of a chest of a user and having a body portion defining a forwardly-facing first surface and a pair of relief areas extending outwardly from the first surface defining a cavity that is adapted to receive a pectoral area of a user, a lower portion that is adapted to cover an upper abdominal area of a user, and a pair of second side portions adapted to wrap about each side of a user.

10 Claims, 2 Drawing Sheets

U.S. PATENT DOCUMENTS 5,623,728 A * 4/1997 Wagner ..... 2/462
5,769,688 A * 6/1998 Holliday ..... 450/57
5,881,395 A * 3/1999 Donzis ..... 2/455
5,943,694 A * 8/1999 Moureaux et al. ..... 2/2.5
5,987,654 A * 11/1999 Chartrand ..... 2/462
6,110,005 A * 8/2000 Stephenson et al. ..... 450/39
6,138,277 A * 10/2000 Gillen et al. ..... 2/102
6,182,288 B1 * 2/2001 Kibbee ..... 2/2.5
6,375,537 B1 * 4/2002 Jankowski ..... 450/39
6,446,273 B1 * 9/2002 Gillen et al. ..... 2/455
6,738,984 B2 * 5/2004 Gillen et al. ..... 2/2.5
2003/0079271 A1 * 5/2003 Gillen et al. ..... 2/102
2003/0167560 A1 * 9/2003 LaShoto et al. ..... 2/463
2004/0128748 A1 * 7/2004 Monica ..... 2/462
2004/0198177 A1 * 10/2004 Jankowski ..... 450/39
2005/0102741 A1 * 5/2005 McQueer ..... 2/459

* cited by examiner

PROTECTIVE ATHLETIC GARMENT

CROSS REFERENCE TO RELATED APPLICATION

This application claims the benefit of U.S. Provisional Application No. 60/519,446, filed Nov. 12, 2003, entitled PROTECTIVE SHOULDER GEAR FOR WOMEN, which is hereby incorporated herein by reference in its entirety.

BACKGROUND OF THE INVENTION

The invention relates to a protective athletic garment for protecting athletes during sporting competition, and in particular to an athletic shoulder pad specifically adapted to protect the unique physical attributes of female athletes.

Typically, athletes competing in sporting events such as football, lacrosse, and ice and field hockey wear protective gear generally comprised of structural members lined with padding, such as athletic shoulder pads. These shoulder pads are typically bilaterally symmetrical and are generally comprised of right and left body arch members that extend over the shoulders of the user and include anterior and posterior portions, or depending chest and back portions, which overlie the chest and back area of the user. The posterior portions, or depending pack portions, may be permanently hinged together on a vertical axis over the athlete's back or spine, while the anterior portion, or depending chest portions, are connected together in a vertical line over the athlete's sternum as by means of straps or lacing. Typically, conventional shoulder pads also utilize a pad disposed beneath the body arch members. The structural members, such as the body arch members, as well as conventional shoulder cups and epaulets are manufactured from a suitable class of material having the requisite strength characteristics to withstand the forces of impact incurred during competition.

Heretofore, the majority of competitors participating in the aforementioned sports have been male, with most protective gear being designed with the protection of the same in mind. As a result, the unique physical attributes of female athletes have not been considered during the design and construction of protective athletic equipment, such as athletic shoulder pads. In particular, athletic shoulder pads of previous design do not provide sufficient space for or adequate protection of the breast area, the upper abdominal area and upper lumbar areas, and the like, of the female athlete.

A protective athletic garment is desired that provides an increase of protection for female athletes during contact sports, and in particular provides sufficient protection for unique female attributes, while simultaneously maintaining or increasing the comfort to the user.

SUMMARY OF THE INVENTION

One aspect of the present invention is to provide a protective athletic garment that includes a pair of shoulder protection plates adapted to cover at least one portion of each shoulder of a user, and a pair of epaulets adapted to cover at least a portion of each shoulder of a user, wherein the pair of epaulets are coupled to the pair of shoulder protection plates, and wherein a top surface of each epaulet extends downwardly from a horizontal when in a free state of movement. The athletic garment also includes at least one rear arch plate adapted to cover at least a portion of a back of a user, wherein the at least one rear arch plate is coupled with the at least one shoulder protection plate, and wherein the at least one rear arch plate includes a lower portion that extends downwardly and is adapted to cover an upper lumbar region of a back of a user, and a pair of first side portions adapted to wrap around each side of a user. The athletic garment further includes at least one front arch plate adapted to cover at least a portion of a chest of a user, coupled to the pair of shoulder protection plates, and having a body portion defining a forwardly-facing first surface and a pair of relief areas extending outwardly from the first surface defining a cavity within an interior of the garment adapted to receive a pectoral area of a user, a lower portion that extends downwardly and is adapted to cover an upper abdominal area of a user, and a pair of second side portions adapted to wrap about each side of a user. The athletic garment further includes a padding member operably coupled to at least a select one of the at least one rear arch plate and the at least one front arch plate, wherein the padding is configured and oriented to provide a gap between an upper most portion of the padding adapted to cover each shoulder of a user, and an uppermost portion of each of the at least one rear arch plate and the at least one front arch plate when the padding is in a free state of movement.

Another aspect of the present invention is to provide a protective athletic garment that includes a shoulder portion adapted to protect a shoulder area of a user from impact, and a rear portion adapted to protect at least a portion of a back of a user from impact, wherein the rear portion is coupled with the shoulder portion. The protective athletic garment further includes a substantially rigid front portion adapted to cover the pectoral area of a user, and having a pair of breast-shaped relief areas extending outwardly from the first surface defining a pair of cavities greater than or substantially equal in size to an A-cup and adapted to receive a pectoral area of a user.

The present inventive athletic shoulder pads provide an increase of protection for female athletes during contact sports, and in particular provides sufficient protection for unique female attributes, while simultaneously maintaining or increasing the comfort to the user. These shoulder pads are economical to manufacture, allow ease-of-use, and are particularly well adapted for the proposed use.

DETAILED DESCRIPTION OF THE PREFERRED EMBODIMENTS

Figure 1:
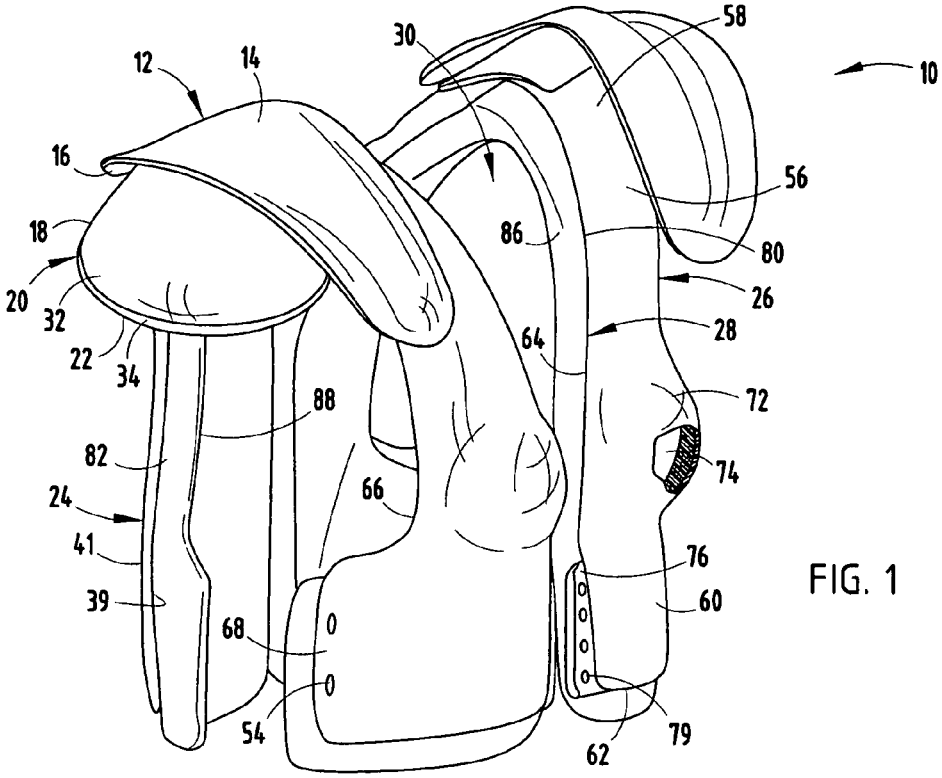
FIG. 1 is a top and front perspective view of the protective athletic garment embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
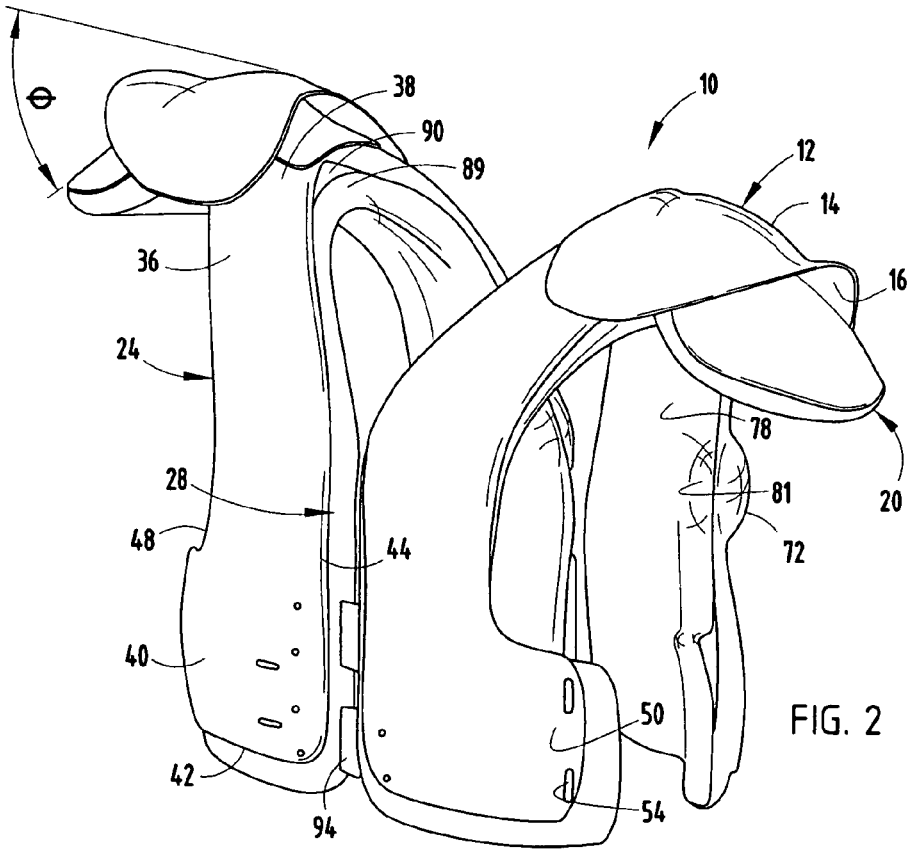
FIG. 2 is a top and rear perspective view of the protective athletic garment.
Figure 3:
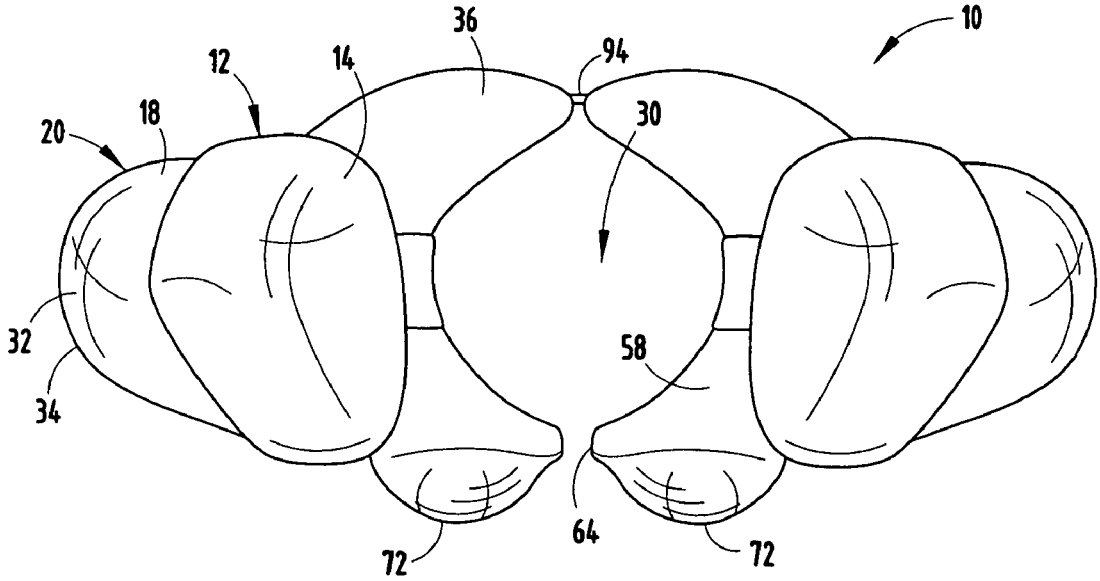
FIG. 3 is a top plan view of the protective athletic garment.
Figure 4:
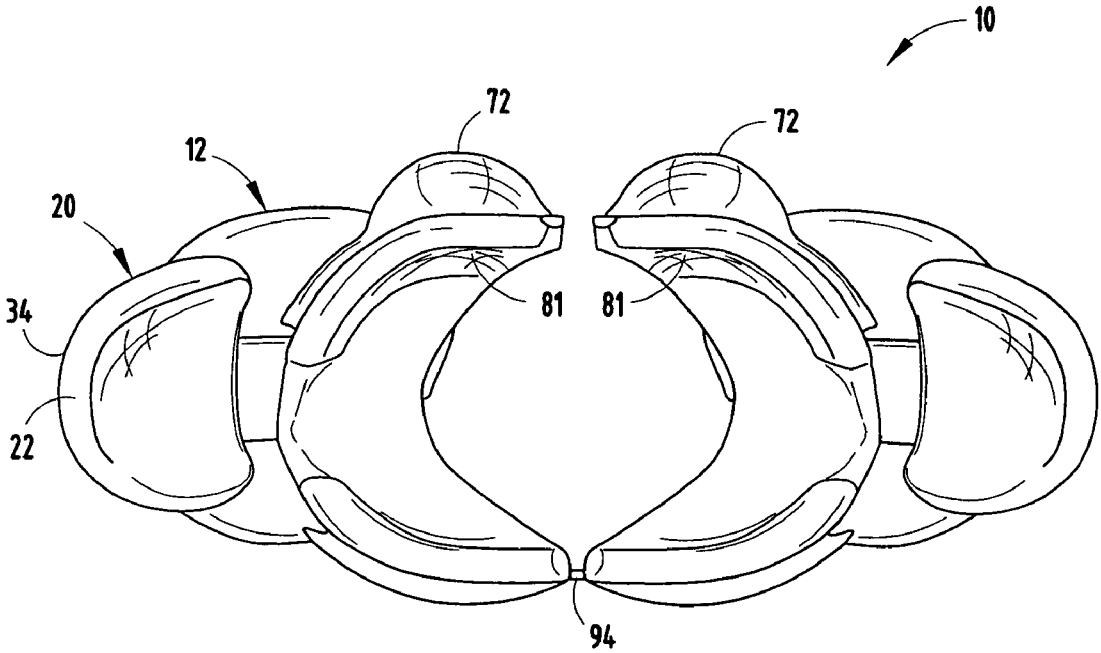
FIG. 4 is a bottom plan view of the protective athletic garment.

The reference numeral 10 (FIGS. 1 and 2) generally designates a protective athletic garment embodying the present invention. In the illustrated example, the protective garment or shoulder pads 10 includes a pair of curved shoulder protection plates 12 having a top surface 14 and a bottom surface 16, and is adapted to cover at least a portion of a respective shoulder of a user. The shoulder pads 10 also include a pair of epaulets 18 each having a top surface 20 and a bottom surface 22 and are adapted to cover at least a portion of a respective shoulder of the user.

The shoulder pads 10 further include a pair of rear arch plates 24 adapted to cover at least a portion of the back of the user, and a pair of front arch plates 26 adapted to cover the front of the user and coupled to the shoulder protection plates 12. The shoulder protection plates 12, the epaulets 18 and the rear and front arch plates 24, 26 are each constructed of a hardened, impact resistant material such as a hardened plastic or vinyl. The shoulder pads 10 further include a padding member 28 operably coupled to the rear arch plate 24 and the front arch plate 26 within an interior 30 of the shoulder pads 10, and that is adapted to cover the back and front of the user.

Each epaulet 18 includes a rigid shell 32 and a pad member 34 secured to the bottom surface 22 so as to provide padding between the shell 32 and the shoulder of the user. The top surface 20 of each epaulet 18 is downwardly curved in the increasingly lateral direction at an angle θ that is greater than or equal to at least 10° when in a free state of movement in order to provide a more comfortable fit for female athletes that typically have deltoid muscle development less than their male counterparts.

Each rear arch plate 24 includes an upper portion 36 having a forwardly-curved upper edge 38 adapted to partially cover a shoulder of the user, and a lower portion 40 adapted to cover the upper lumbar region of the user, and having a lower edge 42 located so as to extend below the lowermost rib of a typical user. Each rear arch plate 24 further includes an inner surface 39, an outer surface 41, an inner edge 44, and an outer edge 48. The outer edge 48 extending along the lower portion 40 of each rear arch plate 24 includes a forwardly-sweeping side portion 50 configured so as to protect the ribs and kidney area of the user. Each side portion 50 includes a plurality of binding apertures 54 located proximate the outer edge 48, and as further discussed below.

Each front arch plate 26 includes an upper portion 56 having a rearwardly-curved upper edge 58 that is adapted to cover a portion of the respective shoulder of the user, and a lower portion 60 adapted to cover the upper abdominal area of the user and having a lower edge 62 extending below the lowermost rib of the typical user. Each front arch plate 26 further includes an inner edge 64 and an outer edge 66. The outer edge 66 extending along the lower portion 60 of each front arch plate 26 includes a rearwardly sweeping portion 68 configured to cooperate with the side portion 50 of the corresponding rear arch plate 24 to protect the side of the user. Each side portion 68 includes a plurality of apertures 54 adapted to receive binding therein in cooperation with the apertures 54 of a respective rear arch plate 24, thereby securely fastening the outer edge 48 of each rear arch plate 24 to an outer edge 66 of a corresponding front arch plate 26. Each front arch plate 26 further includes an outwardly-extending breast-shaped relief area 72 defining a cavity 74 therein that is adapted to receive the pectoral area of a user, and specifically is adapted to receive the breast of a female athlete. The cavities 74 are adapted to provide sufficient clearance within the interior 30, thereby providing proper comfort for the user, as well as for providing sufficient protection. Each cavity 74 can be sized so as to provide adequate space and support for greater than or equal to an A-cup bra size, and may be specifically designed for a particular athlete.

A pair of elongated lace brackets 76 are secured to a respective inner surface 78 of the front arch plates 26 proximate the lower portion 60 thereof such that each lace bracket 76 extends inwardly of the inner edge 64 of the corresponding front arch plate 26. Each lace bracket 76 includes a plurality of apertures 79 spaced along the length thereof and adapted to receive lacing therein, so as to secure the front arch plates 26 to one another and the shoulder pads 10 about the user. Alternatively, the lace brackets 76 may be molded within the padding member 28, such that each lace bracket 76 extends inwardly from the associated inner edge 64.

The padding member 28 includes a left half 80 and a right half 82 each shaped so as to provide a form fit within the rear arch plates 24 and the front arch plates 26. Each half 80, 82 of the padding member 28 includes an inner edge 86 shaped so as to correspond with the inner edge 44 of the rear arch plates 24 and the inner edge 64 of the front arch plates 26, and an outer edge 88 shaped so as to correspond to the outer edge 48 of the rear arch plates 24 and the outer edge 66 of the front arch plates 26. Each half 80, 82 of the padding member 28 includes an outwardly-extending breast-shaped relief area 81 corresponding to and aligned with a respective relief area 72 of the front arch plates 26. The padding member 28 is fastened to the inner surface 39 of rear arch plate 24 and the inner surface 78 of the front arch plates 26 via mechanical-type fasteners (not shown). An upper portion 89 of the padding member 28 is adapted to cover the shoulder area of the user, and is shaped so as to provide a gap 90 between the upper portion 89 of the padding member 28 and the upper edge 38 of each rear arch plate 24 and the upper edge 58 of each front arch plate 26. In the illustrated example, the gap 90 is greater than or equal to about one inch, thereby providing additional protection and shock absorption. The inner edge 86 of the left half 80 and the right half 82 are coupled with one another near the lower portion 40 of each rear arch plate 24 via strapping 94 that is in molded within the left half 80 and right half 82, or attached thereto via mechanical fasteners (not shown).

The present inventive athletic shoulder pads provide an increase of protection for female athletes during contact sports, and in particular provides sufficient protection for unique female attributes, while simultaneously maintaining or increasing the comfort to the user. These shoulder pads are economical to manufacture, allow ease-of-use, and are particularly well adapted for the proposed use.

In the foregoing description, it will be readily appreciated by those skilled in the art that modifications may be made to the invention without departing from the concepts disclosed herein. Such modifications are to be considered as included in the following claims, unless these claims by their language expressly state otherwise. Accordingly, the scope of the present invention should be considered in terms of the following claims and is understood not to be limited to the details of structure and operation shown and described in the specification and drawings.

The invention claimed is:

1. A protective athletic garment, comprising:

a pair of shoulder protection plates adapted to cover at least a portion of each shoulder of a user;

a pair of epaulets adapted to cover at least a portion of each shoulder of a user, wherein the pair of epaulets are coupled to the pair of shoulder protection plates, and wherein a top surface of each epaulet extends downwardly from a horizontal when in a free state of movement;

at least one rear arch plate adapted to cover at least a portion of a back of a user, wherein the at least one rear arch plate is coupled with the at least one shoulder protection plate, and wherein the at least one rear arch plate includes a lower portion that extends downwardly and is adapted to cover an upper lumbar region of a back of a user, and a pair of first side portions adapted to wrap about each side of a user;

at least one front arch plate adapted to cover at least a portion of a chest of a user, coupled to the pair of shoulder protection plates, and having a body portion defining a forwardly facing first surface and a pair of relief areas extending outwardly from the first surface defining a cavity within an interior of the garment that is adapted to receive a pectoral area of a user, a lower portion that extends downwardly and is adapted to cover an upper abdominal area of a user, and a pair of second side portions adapted to wrap about each side of a user; and a padding member operably coupled to at least a select one of the at least one rear arch plate and the at least one front arch plate, wherein the padding is configured and oriented to provide a gap between an uppermost portion of the padding adapted to cover each shoulder of a user, and an upper most portion of each of the at least one rear arch plate and the at least one front arch plate when the padding is in a free state of movement.

2. The protective athletic garment of claim 1, wherein the cavity is breast-Shaped and is greater than or substantially equal to an A-cup size.

3. The protective athletic garment of claim 1, wherein the at least one rear arch plate includes an upper portion adapted to cover at least a portion of an upper back portion of a user, and wherein the upper portion and the lower portion of the at least one rear arch plate are integrally formed.

4. The protective athletic garment of claim 1, wherein the at least one front arch plate includes an upper portion adapted to cover at least a portion of a chest of a user, and wherein the upper portion and the lower portion of the at least one front arch plate are integrally formed.

5. The protective athletic garment of claim 1, wherein the lower portion of the at least one rear arch plate extends downwardly to cover substantially all rib bones of a user.

6. The protective athletic garment of claim 1, wherein the lower portion of the at least one front arch plate extends downwardly to cover substantially all rib bones of a user.

7. The protective athletic garment of claim 1, wherein the gap between the pad and the arch plates is greater than or equal to about 1 inch.

8. The protective athletic garment of claim 1, wherein the pad comprises a foam core and an elastically deformable outer covering.

9. The protective athletic garment of claim 1, wherein each epaulet extends downwardly at an angle of greater than or equal to about 10° from a horizontal when in a free state of movement.

10. The protective athletic garment of claim 1, wherein the at least one rear arch plate includes a left portion and a right portion divided from one another, the at least one rear arch plate includes a left portion and a right portion divided from one another, and wherein the left and right portions of the rear arch plate and the left and right portions of the front arch plate are operably coupled via a web structure.

* * * * *